United States Patent [19]

Welsh

[11] Patent Number: 4,729,568

[45] Date of Patent: Mar. 8, 1988

[54] HORSE RACE BOARD GAME

[75] Inventor: Janet D. Welsh, Carrollton, Tex.

[73] Assignee: Stephen D. Bailey, Mississauga, Canada; a part interest

[21] Appl. No.: 773,613

[22] Filed: Sep. 9, 1985

[51] Int. Cl.[4] ..... A63F 3/00

[52] U.S. Cl. ..... 273/246

[58] Field of Search ..... 273/246, 248

[56] References Cited

U.S. PATENT DOCUMENTS

| | | | |
|---|---|---|---|
| 1,463,871 | 8/1923 | Chisolm | 273/246 |
| 2,546,347 | 3/1951 | Rengel | 273/134 |
| 2,727,746 | 12/1955 | Hawkes | 273/134 |
| 2,823,919 | 2/1958 | Scruggs | 273/134 |
| 3,057,623 | 10/1962 | Barnes | 273/134 |
| 3,463,496 | 8/1969 | Weinstein et al. | 273/134 |
| 3,883,143 | 5/1975 | Kelley et al. | 273/134 |
| 3,963,243 | 6/1976 | Contento | 273/134 |
| 4,057,254 | 11/1977 | Girres | 273/134 |
| 4,082,289 | 4/1978 | Merritt | 273/246 |

*Primary Examiner*—Richard C. Pinkham
*Assistant Examiner*—Benjamin Layno
*Attorney, Agent, or Firm*—Dennis T. Griggs

[57] ABSTRACT

A board game which simulates a racing event, such as a horse race. The game includes a game board having a plurality of parallel racing tracks disposed thereon; a pair of gaming dice for determining the play of the game; and a plurality of playing pieces which are moved along the respective racing tracks during the play of the game. Upon commencement of the game, the dice are rolled to determine which ones of a predetermined number of playing pieces are to be "scratched" from the subsequent race. The remaining playing pieces are placed in the starting positions on the respective tracks and are advanced along the respected tracks in accordance with the roll of the dice. A plurality of sets of playing cards are dealt out randomly to the players. Each set of playing cards is comprised of a plurality of numbered cards corresponding to the numbers of respective ones of the playing pieces. The first playing piece to reach the "finish line" is declared the winner and the players share in the winnings from a central "pot", which is comprised of a plurality of playing chips representing game "money", in accordance with the number of playing cards corresponding to the winning "horse" held by the respective players.

1 Claim, 6 Drawing Figures

HORSE RACE BOARD GAME

FIELD OF THE INVENTION

The present invention relates generally to board games and particularly to a board game apparatus and method for simulating a horse race.

BACKGROUND OF THE INVENTION

Board games in which players compete with one another for fun are a popular source of indoor entertainment. Such board games frequently simulate sporting events and the like, to allow the players to experience the fun and excitement associated with the actual event. One of the most popular sporting events around the world is horse racing because spectators can place bets on the outcome of the various races as well as experience the thrill and excitement of watching the horses race.

DESCRIPTION OF THE PRIOR ART

Board games simulating horse racing and other racing events are known in the art. Typically, such board games include a game board having racing tracks or lanes, playing pieces simulating the race horses and means for determining the movement of the playing pieces along the racing tracks, such as dice, playing cards or a spinning wheel. Such games often involve elaborate methods for betting on horses and jockeys which may be beyond the capability of the average child to comprehend and enjoy. The need therefore exists for a "racing" game which can be readily comprehended and enjoyed by persons of all ages.

OBJECTS OF THE INVENTION

It is therefore the principal object of the present invention to provide an improved board game for simulating a horse race or other racing event.

It is another object of the invention to provide a board game for simulating a horse race or other racing event which can be played and enjoyed by persons of all ages.

It is yet another object of the invention to provide a racing game, which can be comprehended and enjoyed by children.

It is still a further object of the invention to provide a racing board game, in which the individual races may be completed in a relatively short time period.

SUMMARY OF THE INVENTION

These and other objects are accomplished in accordance with the present invention. A board game which simulates a racing event, such as a horse race, is comprised of a game board having a plurality of parallel racing tracks disposed thereon, each of said tracks being assigned a discrete number in a sequence of numbers 2 through 12; a plurality of playing pieces for being positioned at respective starting positions on the corresponding racing tracks at the commencement of the game, each playing piece being assigned a discrete number in the sequence of numbers 2 through 12; a pair of gaming dice for determining the movement of the playing pieces during the play of the game; a plurality of sets of playing cards, each set being comprised of eleven cards bearing respective numbers in the sequence of numbers 2 through 12, the playing cards for being randomly distributed among the players of the game. The dice are rolled by the players to determine the movement of the playing pieces along the respective racing tracks. Players holding playing cards corresponding to the number of the "winning" playing piece are entitled to receive a pro-rata portion of the playing chips contributed to a central "pot" of the players during the game based on the total number of such "winning" cards held by the respective players.

In a preferred embodiment each of the racing tracks has associated therewith first, second, third and fourth non-racing positions. The dice are rolled four times at the commencement of the game so that four of the playing pieces are "scratched" from the race. The playing piece which is scratched on the first roll of the dice is moved to the corresponding first non-racing position; the playing piece which is scratched on the second roll of the dice is moved to the corresponding second non-racing position; the playing piece which is scratched on the third roll of the dice is moved to the corresponding third non-racing position; and the playing piece which is scratched on the fourth roll of the dice is moved to the corresponding fourth non-racing position. Each of the players then pays into the central "pot" for each playing card held by him corresponding to a "scratched" playing piece a number of chips corresponding to the particular non-racing position of each scratched playing piece.

Each of the players of the game thereafter rolls the dice in turn and each of the remaining playing pieces is advanced by one racing position along the corresponding racing track when a roll of the dice yields a combination of numbers corresponding to the assigned number of that particular playing piece until one of the playing pieces reaches the final position on its corresponding racing track, thereby signifying the winner of the race. If, however, a player rolls a combination of numbers with the dice which corresponds to the assigned number of a "scratched" playing piece, that player must pay into the central "pot" a number of playing chips corresponding to the non-racing position of that particular "scratched" playing piece. After the "winner" of the race has been determined, the central "pot" is distributed among the players in accordance with the total number of playing cards in the possession of each player, if any, corresponding to the winning playing piece. Four identical sets of playing cards are preferably used to play the game so that there are a total of four playing cards corresponding to the winning playing piece in each race.

BRIEF DESCRIPTION OF THE DRAWINGS

The objects and advantages of the invention will be apparent from the following detailed description and claims when read in conjunction with the accompanying drawings wherein:

DETAILED DESCRIPTION OF THE PREFERRED EMBODIMENT

Figure 1:
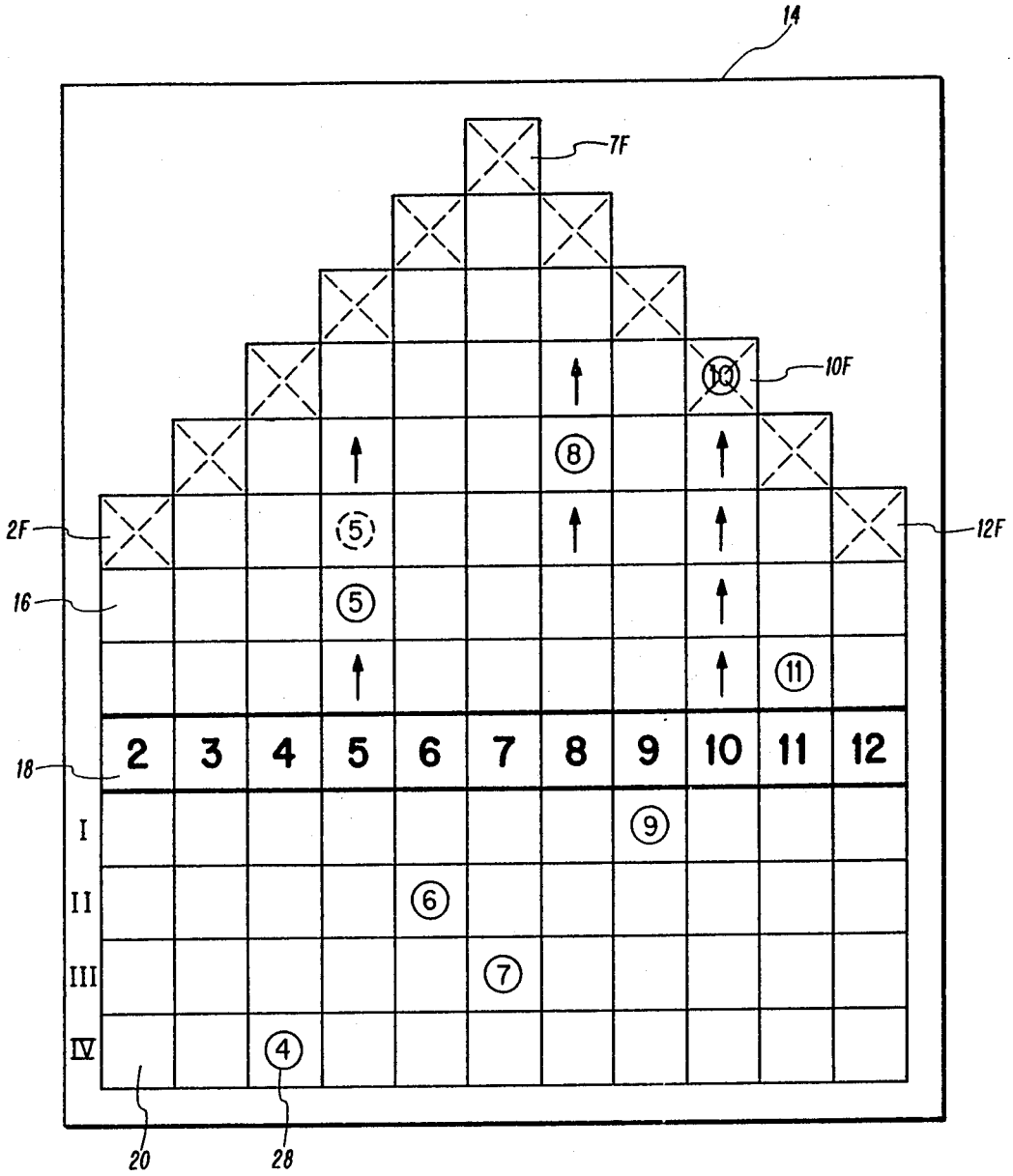
FIG. 1 is a top plan view of a game board included as an element in the present invention, illustrating the parallel racing tracks disposed on the game board and the movement of the playing pieces along the respective tracks.
Figure 2:
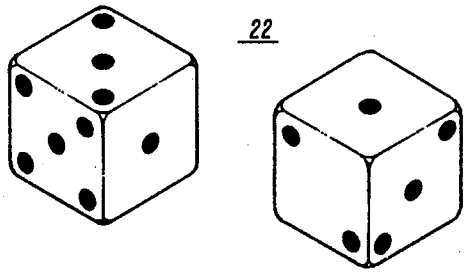
FIG. 2 is a perspective view of a pair of gaming dice used to determine the position and the movement of the playing pieces on the game board.
Figure 3:
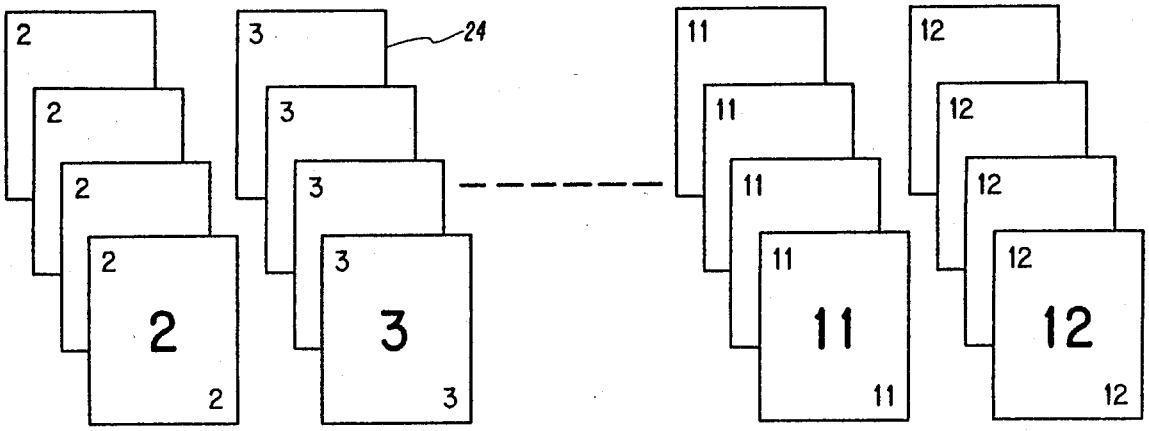
FIG. 3 is a perspective view of four sets of playing cards, each set being comprised of numbered cards which correspond to the respective track numbers of the parallel racing tracks disposed on the game board.
Figure 4:
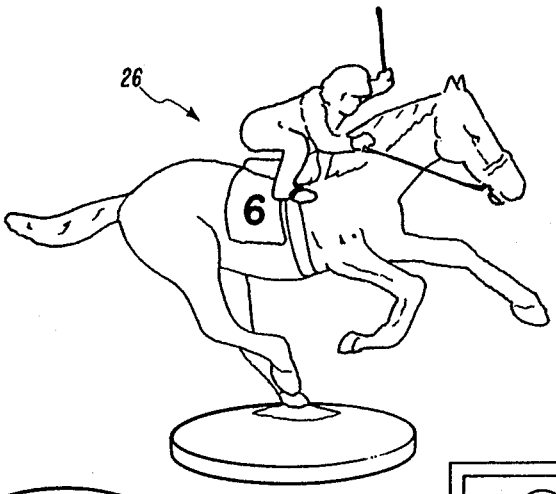
FIG. 4 is a perspective view of figurines of a race horse and jockey, which are used as playing pieces in the present invention.
Figure 5:
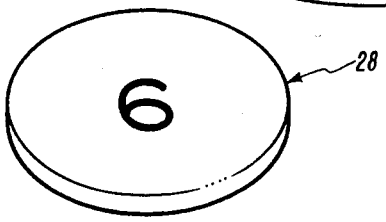
FIG. 5 is a perspective view of a "scratch" token which may be placed at a predetermined "scratch" position on the game board to signify that a particular horse has been "scratched" from the race.
Figure 6:
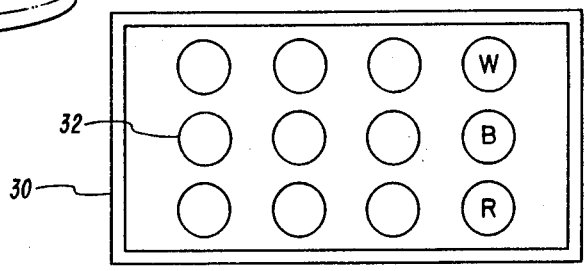
FIG. 6 is a top plan view of a receptacle for holding red, white and blue playing chips, to simulate a house ticket booth at a race track.

In the description which follows, like parts are marked throughout the specification and drawings with the same reference numerals, respectively. The drawings are not necessarily to scale and in some instances proportions may have been exaggerated in order to more clearly depict certain features of the invention.

Referring now to FIG. 1, a game board 14 is comprised of eleven parallel racing tracks numbered 2 through 12. Each racing track is comprised of a predetermined number of "racing" positions 16, which are represented by individual blocks. The row of blocks 18 in the central portion of board 14 which are marked with the number 2 through 12 are "starting" positions for the respective playing pieces. The row of starting positions 18 simulates a starting gate at a typical horse race track. The racing positions 2F through 12F farthest from the corresponding starting position 18 on each racing track, as indicated by the dotted line X, represents the "finish" line for the race.

Racing track 7 has eight racing positions 16 between the corresponding starting position 18 and the finish line, which is the greatest number of racing positions 16 of any of the racing tracks. Racing tracks 2 and 12 have three racing positions 16 between the corresponding positions and the finish line, which represents the smallest number of racing positions 16 among the racing tracks. The reason for the differences in the number of racing positions 16 among the various tracks is that the number of racing positions in each racing track is chosen in accordance with the odds of rolling a combination of numbers with a pair of gaming dice, the total of which is equal to the number assigned to the particular racing track. For example, when two gaming dice are rolled, there is only one combination which can yield the number "2" (the number "1" on each of the dice) and only one combination which can yield the number "12" (the number "6" on each of the dice). On the other hand, there are six possible combinations of numbers which can be rolled to yield the number "7" (3 plus 4; 4 plus 3; 1 plus 6; 6 plus 1; 2 plus 5; and 5 plus 2). The number of racing positions for the other track numbers 3, 4, 5, 6, 8, 9, 10 and 11 are also chosen in accordance with this principle.

Game board 14 further includes a plurality of "scratch" positions 20, which are divided into four rows marked I, II, III and IV. Each scratch position 20 is represented by an individual block on game board 14. In accordance with the rules of the game, as will be hereinafter described in greater detail, four of the playing pieces are disqualified from competition in each race to simulate race horses being "scratched" from the race, as is often the case in an actual horse race. The four "scratched" horses are placed at selected ones of the "scratch" positions 20 prior to the start of the race.

Referring also to FIGS. 2, 3, 4, 5 and 6, the other elements needed to play the racing game in accordance with the present invention are depicted. A pair of gaming dice 22 is used to determine the play of the game and four identical sets of playing cards 24 are dealt at random to the players at the commencement of the game to represent the relative "stakes" wagered by the game's players on each of the "horses" in the race. There are eleven sets of playing cards 24 numbered 2–12 containing four cards in each set, so that each set corresponds with the number assigned to each of the racing tracks on the game board.

The board game according to the present invention further includes eleven playing pieces 26, each of which is marked with a discrete number in the sequence 2 through 12. Each playing piece 26 is comprised of figurines of a horse and jockey. At the commencement of the game, each playing piece 26 is positioned at the starting position 18 of the particular racing track corresponding to the number marked on the particular playing piece 26. if a particular playing piece 26 is "scratched" from the race, the jockey figurine is removed from the horse figurine and the horse figurine is placed at a predetermined "scratch" position 20 associated with the corresponding racing track to indicate that the "horse" has been scratched from the race. Alternatively, a scratch token 28 is placed at the predetermined "scratch" position 20 instead of the horse figurine.

A receptacle 30 is preferably used for storing a plurality of white, blue and red playing chips 32, which represent "money" exchanged among the players during the course of the game. As is the convention, each white chip represents one unit of money, each blue chip five units, each red chip ten units. Each player starts the game with the same number of chips 32, preferably fifty chips each or the equivalent thereof. Receptacle 30 functions as a central "pot" for each race and simulates a house ticket booth at a race track where spectators place bets and collect money on winning tickets.

At the beginning of a game, each player receives fifty units of playing chips 32. The playing pieces 26 are placed at the respective starting positions 18 on the corresponding racing tracks. One of the players is then designated as the dealer. The dealer shuffles all of the playing cards 24 together and randomly deals out all of the playing cards 24 to the players of the game. The game can be played effectively with a minimum of two players, but the optimum number of players is six.

After playing cards 24 are dealt, each of the players turns the cards over and arranges them in small groups according to the numbers marked thereon. The dealer rolls the dice 22 four times and upon each such roll one of the playing pieces 26 is "scratched" from the race. On the first roll of the dice, the playing piece 26 marked with the number corresponding to the combination of numbers rolled by the dice is moved to the corresponding first "scratch" position I below the corresponding starting position 18. On the second roll of the dice, the playing piece 26 marked with the number corresponding to the combination of numbers rolled by the dice is moved to the corresponding second "scratch" position II below the corresponding starting position and so on until four of the playing pieces 26 are scratched from the race. For example, in FIG. 1, the four rolls of the dice yielded the sequence of respective combinations "9", "6", "7" and "4", thereby scratching the playing pieces 26 marked "9", "6", "7" and "4" from the race.

The corresponding horse figurines or alternatively four scratch tokens 28 are placed at the corresponding "scratch" positions, I, II, III and IV, as shown.

After four of the "horses" have been "scratched" from the race, each player is required to pay into the central "pot", for each playing card 24 held by that player which bears a number corresponding to a "scratched" playing piece 26, a number of playing chip units equal to the respective "scratch" positions 20 of the "scratched" playing pieces 26. In FIG. 1, playing pieces marked with numbers 9, 6, 7, and 4 have been "scratched" from the race and placed in respective "scratch" positions I, II, III and IV. Therefore, each player must pay into the central pot four chips for each playing card 18 held by him bearing the number "4"; three chips for each playing card held by him bearing the number "7"; to chips for each playing card held by him bearing the number "6"; and one chip for each playing card held by him bearing the number "9". The players then discard all of the playing cards 24 corresponding to the "scratched" positions and retain the remaining cards 24 for the subsequent race.

To begin the race, the player to the left of the dealer rolls dice 22. If the combination of numbers resulting from the roll of dice 22 equals the number of a "scratched" playing piece 26, the player rolling dice 22 pays into the central "pot" a number of chips 32 equal to the "scratch" position 20 occupied by that particular "scratched" playing piece 26. If the combination of numbers resulting from the roll of dice 22 equals the number of a playing piece 26 still in the race, that particular playing piece 26 advances one racing position 16 from starting position 18 towards the "finish line". The next player to the left then rolls dice 22 and the game continues with each of the players in turn rolling dice 22 once until one of the playing pieces 26 reaches the corresponding "finish line".

The first playing piece 26 to reach its corresponding "finish line" is declared the winner of the race and each player collects a portion of the central "pot" based on the number of playing cards 24 held by that player corresponding to the finish line position of the winning playing piece 26. The central "pot" is comprised of all of the playing chips 32 paid into the pot previously by the players for the "scratched" playing pieces 26. When four sets of playing cards 24 are used, there are four identical cards corresponding to the winning playing piece 26. The player who holds all four of the cards is then able to collect all of the central "pot". The player who holds three of the cards is able to collect $\frac{3}{4}$ of the "pot". Two of the cards entitles a player to collect $\frac{1}{2}$ of the "pot" and one card entitles a player to $\frac{1}{4}$ of the pot. The game may be interrupted or discontinued at any time after each race or subsequent races may be conducted as desired until one of the players wins all of the playing chips 32.

In an alternative embodiment, the dealer has the choice to "scratch" any four of the playing pieces 26 that he chooses and can arbitrarily assign the "scratched" playing pieces 26 to respective "scratch" positions 20 prior to the playing cards 24 being dealt, thereby dispensing with the initial four rolls of dice 22 to determine which ones of playing pieces 26 are to be "scratched". In another embodiment, the players may bid on "scratched" playing pieces 26 to reinstate the "jockey" assigned to the "scratched" playing piece 26 into the race. If the "jockey" ultimately wins the race, the player who won the bid for that "jockey" wins all of the "pot".

The board game according to the present invention provides a simple, easy to understand racing game, which can be played and enjoyed by persons of all ages. The game contains much of the excitement and realism of an actual horse race and includes aspects, such as the individual races, which may be completed quickly to hold the attention of young children as well as aspects, such as trying to win all of the playing chips, which will hold the attention of the players for a substantial period of time.

Various embodiments of the invention have now been described in detail. Since changes and modifications to the above-described embodiments may be made without departing from the nature, spirit and scope of the invention, the invention is not to be limited to said details, except as set forth in the appended claims.

What is claimed is:

1. A race game apparatus comprising:

at least two dice cubes, each having indicia representative of the numerals one through six positioned on the six faces thereof with a different indicia on each face;

a game board having at least eleven lanes provided thereon, said lanes having successive integral numerical designations corresponding to the possible numerical totals that can be achieved by throws of said dice cubes;

a plurality of game pieces wherein there are at least as many game pieces as there are lanes and said game pieces are adapted to be moved by players along said lanes during the course of a game; and, indicia longitudinally dispersed along said lane determining a plurality of stopping points for said game pieces, the number of indicia in substantially all of said lanes having a particular relationship to dice face value permutations, said relationship being that the number of indicia in a given lane is equal to the number of permutations of dice face values which add to equal said given lane's numerical designation plus an arbitrary constant.

* * * * *